US005636585A

United States Patent [19]

Schulz

[11] Patent Number: 5,636,585

[45] Date of Patent: Jun. 10, 1997

[54] SAILBOAT WITH HYDROFOIL MEMBERS

[76] Inventor: Walter A. Schulz, 14 Honeysuckle La., Portsmouth, R.I. 02871

[21] Appl. No.: 546,378

[22] Filed: Oct. 20, 1995

[51] Int. Cl.[6] ..... B63B 43/14

[52] U.S. Cl. ..... 114/123; 114/280; 114/282

[58] Field of Search ..... 114/39.1, 61, 123, 114/121, 125, 271, 274, 278, 280, 282, 283, 292, 162

[56] References Cited

U.S. PATENT DOCUMENTS

| | | | |
|---|---|---|---|
| 3,286,673 | 11/1966 | Nason . | |
| 3,949,695 | 4/1976 | Pless | 114/283 |
| 4,441,445 | 4/1984 | DeWeck | 114/123 |
| 4,635,577 | 1/1987 | Palmquist | 114/274 |
| 4,926,773 | 5/1990 | Manor | 114/274 |
| 5,174,233 | 12/1992 | Nielsen | 114/123 |

*Primary Examiner*—Stephen Avila
*Attorney, Agent, or Firm*—Salter & Michaelson

[57] ABSTRACT

A hydrofoil member for a sailboat of the type having a single hull with no fixed ballast includes an elongate arm portion which extends laterally outwardly away from the sailboat along a generally horizontal plane when in use. The arm portion has an upwardly-facing surface, a downwardly-facing surface, and an outer end portion which flares upwardly relative to the horizontal plane. The hydrofoil member further comprises a pontoon element mounted on the downwardly-facing surface of the arm portion at the outer end portion. The pontoon element is adapted to engage and displace water when in use for stabilizing the sailboat. The arm has is capable of being retracted to stow the hydrofoil member in a parallel position against the hull when not in use.

9 Claims, 7 Drawing Sheets

SAILBOAT WITH HYDROFOIL MEMBERS

BACKGROUND AND SUMMARY OF THE INVENTION

This invention relates generally to water vessels, and more particularly to a single hulled sailboat designed to have a pair of outwardly extending and retractable horizontal hydrofoil members which eliminate the need for centerline ballast or keel commonly found in most sailboats.

At the present time, the only effective method of offsetting the heeling moment caused by wind pressure on the sails and mast of a mono-hull sailboat is by placing weight in the form of a lead ballast as low as possible in a keel. Most sailboats use between thirty-five to forty percent of displacement/weight of the sailboat for ballast. For example, a 20,000 lbs sailboat normally carries about 7,500 lbs of fixed weight for ballast. The sail plan of the sailboat must be designed to be large enough to move the construction weight of the sailboat, the weight of any machinery and tanks mounted therein, the weight of people and gear, and the weight of the fixed ballast.

Water has also been used to reduce the amount of lead or iron ballast by placing tanks on each side of the sailboat's hull and pumping water from one tank to the other so as to increase the vessel's stability. One disadvantage associated with this arrangement is that the water ballast tank placement and size is limited by the shape and size of the vessel. Since the tanks are relatively close to the centerline, the amount of water in pounds (62.4 lbs per cubic feet for fresh water) must approximate the weight of the fixed ballast removed. This is difficult to achieve with water since a cubic foot of lead weighs approximately 700 lbs and a cubic foot of water is less than ten times that weight, i.e., 62.4 lbs. Thus, in order to substitute water for lead, a large amount of space within the hull of the sailboat must be dedicated for the large tanks which would be required to house the water.

Another issue confronting sailboat designers is draft which is defined as the vertical depth of the hull below the water line. Draft reduction has been achieved for centuries with the use of movable and/or swingable centerboards, dagger boards, and lee boards. However, when any of these types of boards are raised for shallow water sailing, the sailboats do not sail well. For example, with a catboat hull having less than eighteen inches of draft, it is nearly impossible to control under sail with the board raised due to leeward movement, i.e., the hull sliding sideways from the wind pressure on the sail. Most centerboard mono-hulls without keel surface cannot be sailed effectively with the centerboard raised. Thus, the advantage of having shallow water draft is negated since the board must be lowered to control the sailboat.

Multi-hull designs address some of the sailing draft issues. The two multi-hull type sailboats commonly found on the market are the catamaran and the trimaran. The catamaran utilizes two equal sized hulls joined together by a beam structure. The trimaran incorporates a narrow main hull with two smaller pontoons placed on either side of the main hull. Both multi-hull designs use width/beam to obtain stability and to offset the pressure caused by the sails. Multi-hulls do not use fixed ballast, and the hull shapes are extremely shallow and narrow as compared to mono-hull vessels. However, they still require a centerboard or dagger board for sailing performance to control leeward movement.

One problem associated with multi-hull sailboats is the extreme beam which precludes the vessel from docking in conventionally spaced slips found in marinas. Even in crowded mooring and anchorage areas, multi-hull vessels can present problems due to their width. For example, a common thirty-two foot catamaran typically has over an eighteen foot beam whereas a mono-hull of the same length has a ten or an eleven foot beam. Some trimarans are designed with a folding or swing mechanism which moves the two outboard hulls closer to the main hull for docking and trailering. However, with this design, the main hull is very narrow and requires a dagger board. Another disadvantage of multi-hull designs is that they are difficult to self-right after capsizing. In the extreme situation where wind or seas capsize a multi-hull, the same factors that allow them to sail without ballast (e.g., excessive beam), prevent them from returning upright.

The present invention is directed to a horizontal hydrofoil member for a mono-hull sailboat of the type having a mono-hull with no fixed ballast comprising an elongate arm portion adapted to extend laterally outwardly away from the sailboat along a generally horizontal plane when in use. The arm portion has an upwardly-facing surface, a downwardly-facing surface, and an outer end portion which flares upwardly relative to the horizontal plane. The hydrofoil member further comprises a pontoon element mounted on the downwardly-facing surface of the arm portion at the outer end portion. The pontoon element is adapted to engage and displace water when in use and has low drag and high lift capabilities for stabilizing the sailboat.

More specifically, the pontoon element is of hollow construction for selectively storing fluid therein. The pontoon element, when filled with fluid, provides a ballast force against the sailboat for stabilizing the same. Means for supplying fluid to the pontoon element from the sailboat comprises a pump housed within the sailboat and a hose extending between the pump and the hollow pontoon element. The pump is in fluid communication with a reservoir of fluid for pumping fluid into and out of the hollow pontoon element.

The hydrofoil member further comprises means for pivotally and hingedly mounting the arm portion of the hydrofoil member on the sailboat. The mounting means comprises a plate pivotally mounted by a pin to the sailboat wherein the arm portion is hingedly attached to the plate. The arrangement is such that the arm portion and pontoon element are movable between a stowed position in which they extend along a side of the sailboat and a use position in which the arm portion via the leg portion is pivoted to extend vertically and then hingedly lowered so as to achieve its generally horizontal position. The mounting means further comprises a support bracket mounted on the sailboat wherein the plate is pivotally mounted by the pin to the support bracket. A thrust arm controls the elevation of the hydrofoil member with respect to the horizontal plane. The thrust arm is pivotally attached at an outer end to the arm portion of the hydrofoil member and threadably attached at its other opposite end to the support bracket. The support bracket is mounted on the deck of the boat to an adjustable flat track. The arrangement is such that the plate, arm portion and support bracket can be moved along the track so as to adjust the location of the hydrofoil member with respect to the sailboat.

Accordingly, among the several objects of the present invention are the provision of a hydrofoil member mounted on a hull of sailboat which enables the sailboat to be designed without fixed ballast weight or a centerboard, thereby decreasing the weight of the sailboat for making it faster, and decreasing the draft of the sailboat for enabling it to travel in shallow waters; the provision of such a hydrofoil member which is capable of being selectively filled with fluid for stabilizing purposes; the provision of such a hydrofoil member which is pivotally and hingedly attached to the hull of the sailboat thereby enabling the operator of the sailboat to move the hydrofoil member to a stowed position when docking or transporting the sailboat; the provision of such a hydrofoil member which is especially designed for stabilizing the sailboat; the provision of such a hydrofoil member which is lightweight; the provision of such a hydrofoil member which is adjustable to provide for angle of lift attack and foil dihedral to adjust drag component; and the provision of such a hydrofoil member which is relatively simple to operate and which moves easily to a use position.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

Corresponding reference numerals designate corresponding parts throughout the several views of the drawings.

DETAILED DESCRIPTION OF THE PREFERRED EMBODIMENT

Figure 1:
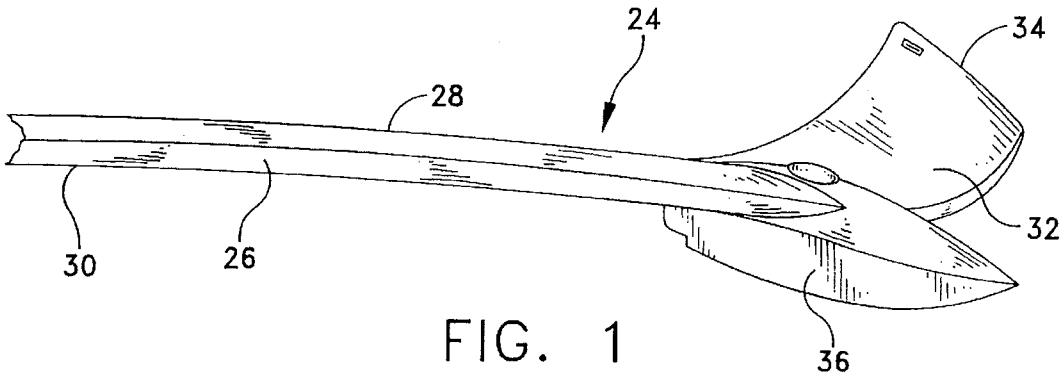
FIG. 1 is a side perspective view of a hydrofoil member of the present invention.

Referring now to the drawings, and more particularly to FIGS. 2–6, there is generally indicated at 20 a sailboat having a single hull, generally indicated at 22, and a pair of hydrofoil members, each generally indicated at 24, of the present invention which stabilize the hull 22 during sailing. It should be noted that the right-hand hydrofoil member 24 is a mirror image of the left-hand hydrofoil member 24, but is otherwise identically constructed. The hull 22 is of conventional design for mono-hull sailboats of this type except that it lacks any centerline ballast provided by lead weight mounted on the keel disposed within the hull 22. Preferably, the hull 22 lacks a keel so that the sailboat 20 is maneuverable in shallow waters. Since the sailboat 20 is stabilized by the two hydrofoil members 24 which further reduces the weight of the sailboat, there is no lead in the hull 22. Thus the single-hull sailboat 20 of the present invention is faster than conventionally constructed sailboats because it is light-weight.

Figure 4:
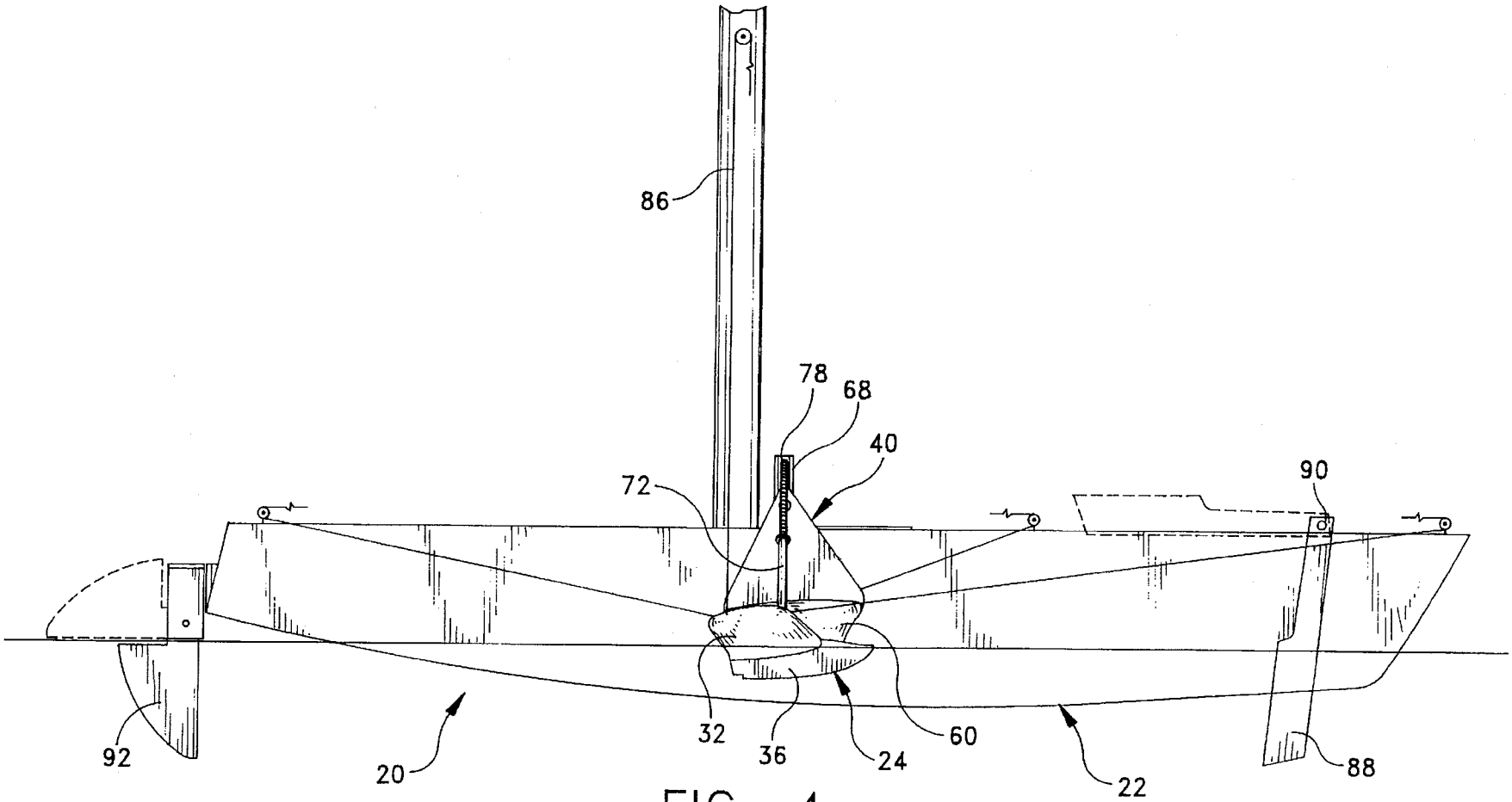
FIG. 4 is a side elevational view similar to FIGS. 2 and 3 illustrating the hydrofoil member in a use position.
Figure 5:
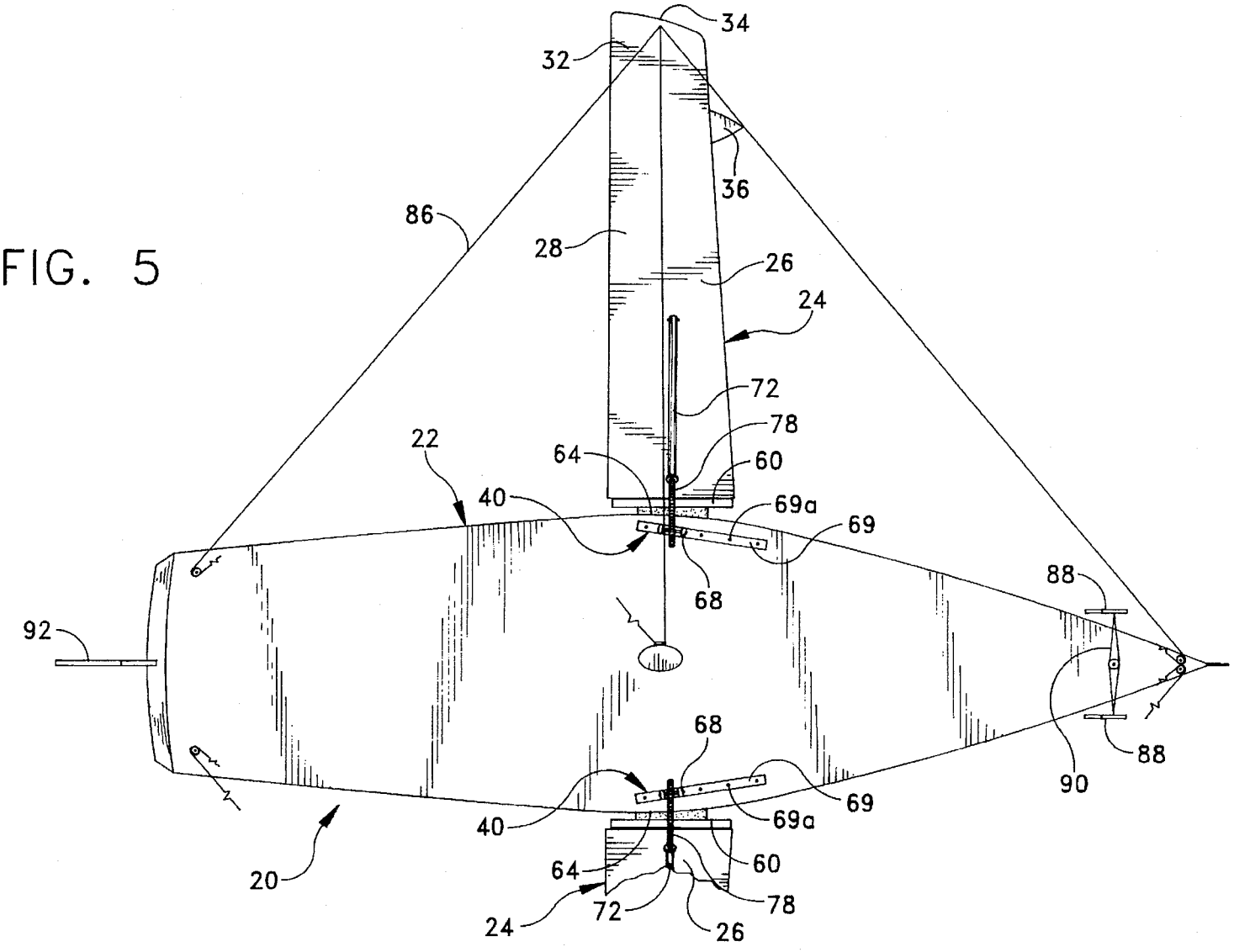
FIG. 5 is a partial top plan view thereof.
Figure 6:
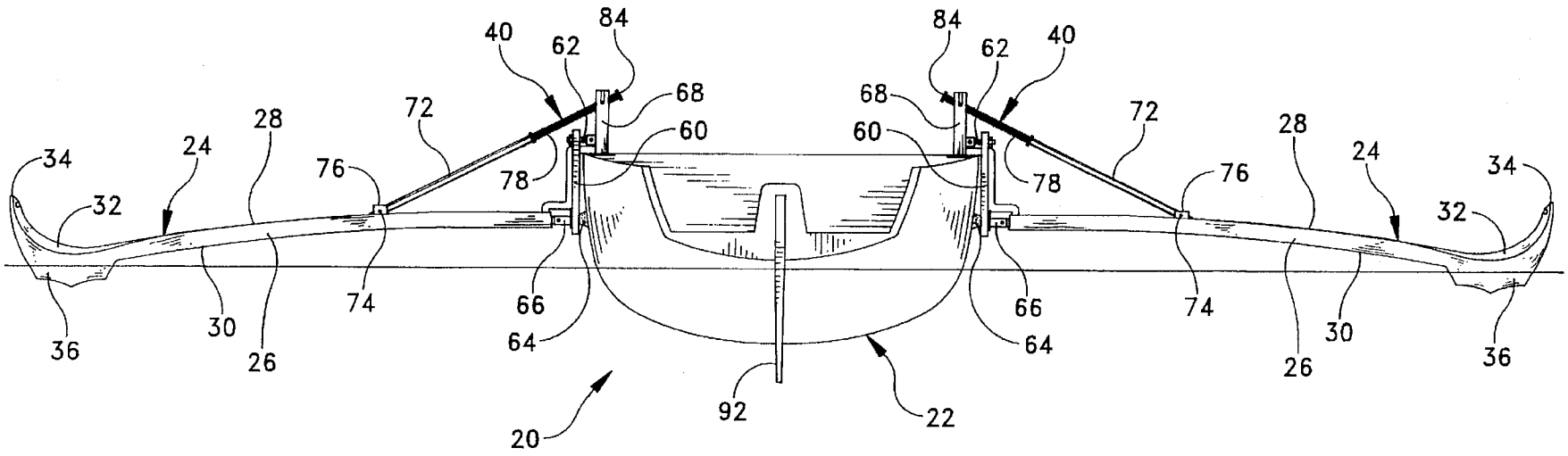
FIG. 6 is a rear elevational view thereof with the sailboat at zero degree heel and the hydrofoil members at zero degree dihedral.
Figure 7:
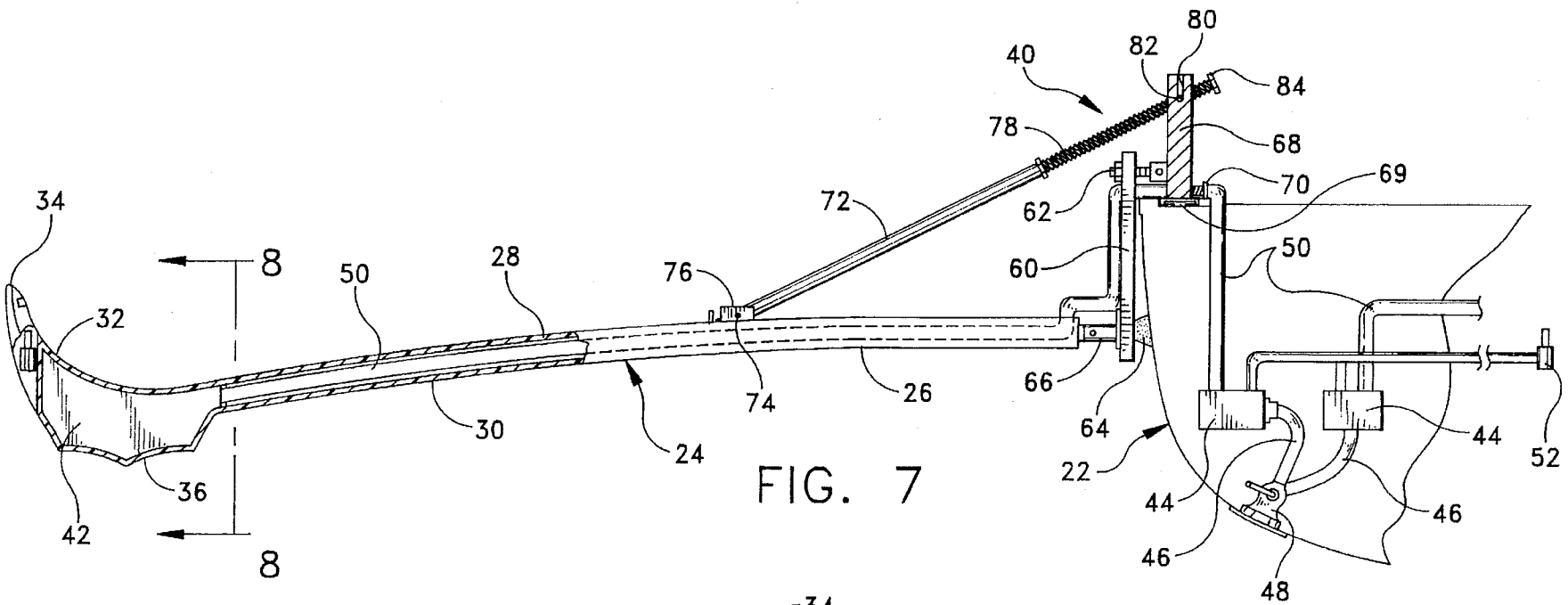
FIG. 7 is a partial, enlarged fragmentary rear elevational view thereof illustrating the end of the hydrofoil member in cross section.

As illustrated best in FIGS. 1 and 7, each hydrofoil member 24 comprises an elongate arm portion 26 which, when in the use position illustrated in FIGS. 4–6, extends laterally outwardly away from the hull 22 of the sailboat 20 along a generally horizontal plane. The arm portion 26 of each hydrofoil member 24 has an upwardly-facing surface 28, a downwardly-facing surface 30, and an outer end portion 32 which flares upwardly at 34 relative to the plane of the arm portion 26. The shape of the arm portion 26 and end portion 32 enhances the hydrofoil member's ability to cut through air and water without causing undo drag on the hydrofoil member and thus on the sailboat 20. A pontoon element 36 is mounted on the downwardly facing surface 30 of the arm portion 26 at the outer end portion 32. The pontoon element 36 is provided for engaging and displacing water when the hydrofoil member 24 is in use to stabilize the sailboat 20. Moreover, as will be discussed in greater detail below, the pontoon element 36 can hold water for ballast purposes (i.e., for offsetting the force caused by wind on the sails of the sailboat). Preferably, the pontoon element 36 is integrally formed with the arm portion 26 and can be fabricated from any durable, rugged and light-weight material, such as plastic, fiberglass, or the like.

Figure 8:
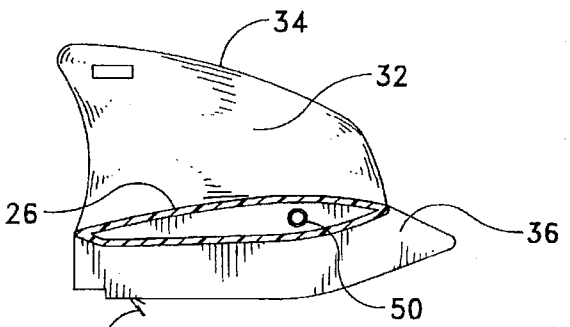
FIG. 8 is a cross-sectional view taken along line 8—8 of FIG. 7.

Turning now to FIGS. 7 and 8, there is illustrated the hydrofoil member 24 mounted on the hull 22 of the sailboat 20 by mounting means which is generally indicated at 40. As shown, the pontoon element 36 of the hydrofoil member 24 is of hollow construction which defines a ballast tank 42 for storing fluid therein. The arm portion 26 can range between six to fourteen feet long, depending upon the size of the hull 22 of the sailboat 20, thereby placing the ballast tank 42 of the pontoon element 36 a corresponding distance away from the centerline of the hull 22. Thus, a cubic foot of water disposed in the ballast tank 42 of the pontoon element 36 creates a moment force of 624 lbs on the hull 22 of the sailboat 20 when the arm portion is ten feet long. It should be noted that the length of the arm portion 26 is determined by the size of the sailboat and height of the sail plan. For example, a twenty-four foot sailboat requires approximately an eight foot arm portion, whereas a forty-four foot sailboat requires approximately sixteen foot arm portion.

In order to pump water in and out of the pontoon element 36 of each hydrofoil member 24, a pair of pumps (broadly referred to as "fluid supplying means"), each generally indicated at 44, one for each hydrofoil member 24, are housed within the hull 22 of the sailboat 20. The pumps 44 are in fluid communication via hoses 46 and a plug housing 48 with open water, and are in fluid communication with the pontoon elements 36 of the hydrofoil members 24 by hoses 50. The plug housing 48 is sealably mounted on the hull 22 of the sailboat 20 in a manner well-known in the art. A power cord 52 is provided for supplying electricity to the pumps 44. More particularly, for each hydrofoil member 24, the hose 50 is embedded within the arm portion 26 to the pontoon element 36. Another method of evacuating fluid from the pontoon element 36 is by providing a valve 54 (see FIG. 8) in the bottom of the element 26 which is suitably controlled to empty water from the pontoon element 36. The arrangement is such that depending upon the force of wind on the sails of the sailboat 20, water can be supplied to and evacuated from the ballast tank 42 of each pontoon element 36 of the hydrofoil members 24 for stabilizing the sailboat 20. A suitable control (not shown) can be provided for controlling the flow of water to and from the ballast tanks 42 of the hydrofoil members 24. It should be understood that the provision of one pump 44 can be provided and still fall within the scope of the present invention.

The mounting means 40 of the present invention is capable of pivotally and hingedly mounting the arm portion 26 of the hydrofoil member 24 on the hull 22 of the sailboat 20 in such a manner that the member 24 can move between a stowed position (FIG. 2) in which the hydrofoil member 24 extends along the side of the sailboat 20 and a use position (FIGS. 4–6) in which the hydrofoil member 24 is pivoted from its stowed position to extend generally vertically (FIG. 3) and then is hingedly lowered so as to achieve its generally horizontal position.

Means 40 comprises a triangularly-shaped plate 60 pivotally mounted by a pin 62 on the hull 22 of the sailboat 20. An elastomeric stop 64 is mounted on the backside of the plate 60 so as to prevent the plate 60 from rubbing up against the hull 22 of the sailboat 20 and thereby damaging the same. The arm portion 26 of the hydrofoil member 24 is mounted on the plate 60 by a two-part hinge 66 which extends along the outer end of the arm portion 24 and has a section suitably attached to the arm portion 24 by screw fasteners and another section attached to the plate 60 by screw fasteners. More specifically, the pin 62 is releasably attached to an support bracket 68 which is slidably mounted on a track 69 fixedly mounted on the deck of the sailboat. The pin 62 is the type known as a "fast" pin which is especially suited for quick connections. There is an opening (not shown) formed in the bracket 68 through which the pin 62 is inserted for attaching the arm 24, 26 to the support bracket 68. The bracket 68 in turn is mounted on the track 69 in any suitable manner at any of the varying positions formed along the length of the track 69. The track has a plurality of stops 69*a* (FIG. 5) for locating the support bracket along the track so that the hydrofoil member, plate and thrust arm can be moved along the length of the track. The plate 60 and the hydrofoil member 24 may be adjusted to control the angle of attack of the foil and dihedral. The purpose of this construction is to enable the hydrofoil members 24 to be mounted forwardly on the hull 22 of the sailboat 20 away from the widest part of the hull 22 so as to decrease the width of the sailboat 20 either during its docking or transport. The hose 50, which connects the pump 44 to the pontoon element 36, is capable of being disconnected at 70 so as to enable the hydrofoil member 24 to be located anywhere along the length of the support track 69.

Providing vertical support and adjustment to the hydrofoil member 24 is a thrust arm 72 which is pivotally attached at one of its outer ends to the arm portion 26 of the hydrofoil member 24 by means of a fast pin 74 and bracket 76, and threadably attached at its other opposite, threaded end 78 within a threaded opening (not shown) formed in the support bracket 68. The thrust arm 72 controls the elevation and angle of the hydrofoil member 24 with respect to the horizontal plane. As shown in FIG. 7, a slot 80, extending in a direction perpendicular to the threaded opening), is provided in the support bracket 68 for receiving a fast pin 82 or other suitable removable fastener for locking the location of the thrust arm 72 thereby maintaining the hydrofoil member at a desired elevation and angle. The slot opens upwardly so that if the sailboat 10 capsizes, the thrust arm 72 falls out of the support bracket 68. A handle 84 is provided at the outer end of the thrust arm 72 for enabling the person operating it to easily rotate the thrust arm 72 so as to adjust the elevation and angle hydrofoil member 24. Suitable rigging 86 illustrated in FIGS. 3–5 assists the operator in moving the hydrofoil members 24 between their stowed and use positions.

Figure 2:
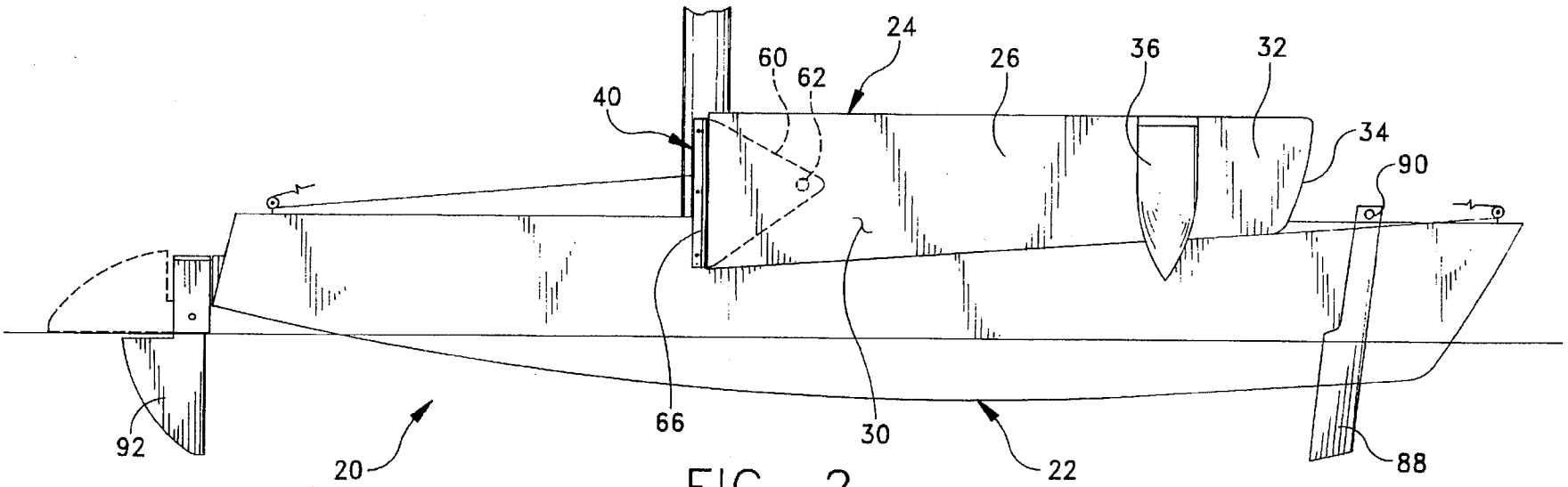
FIG. 2 is a side elevational view of the hydrofoil member pivotally and hingedly attached to a sailboat with the hydrofoil member being illustrated in a stowed position.
Figure 3:
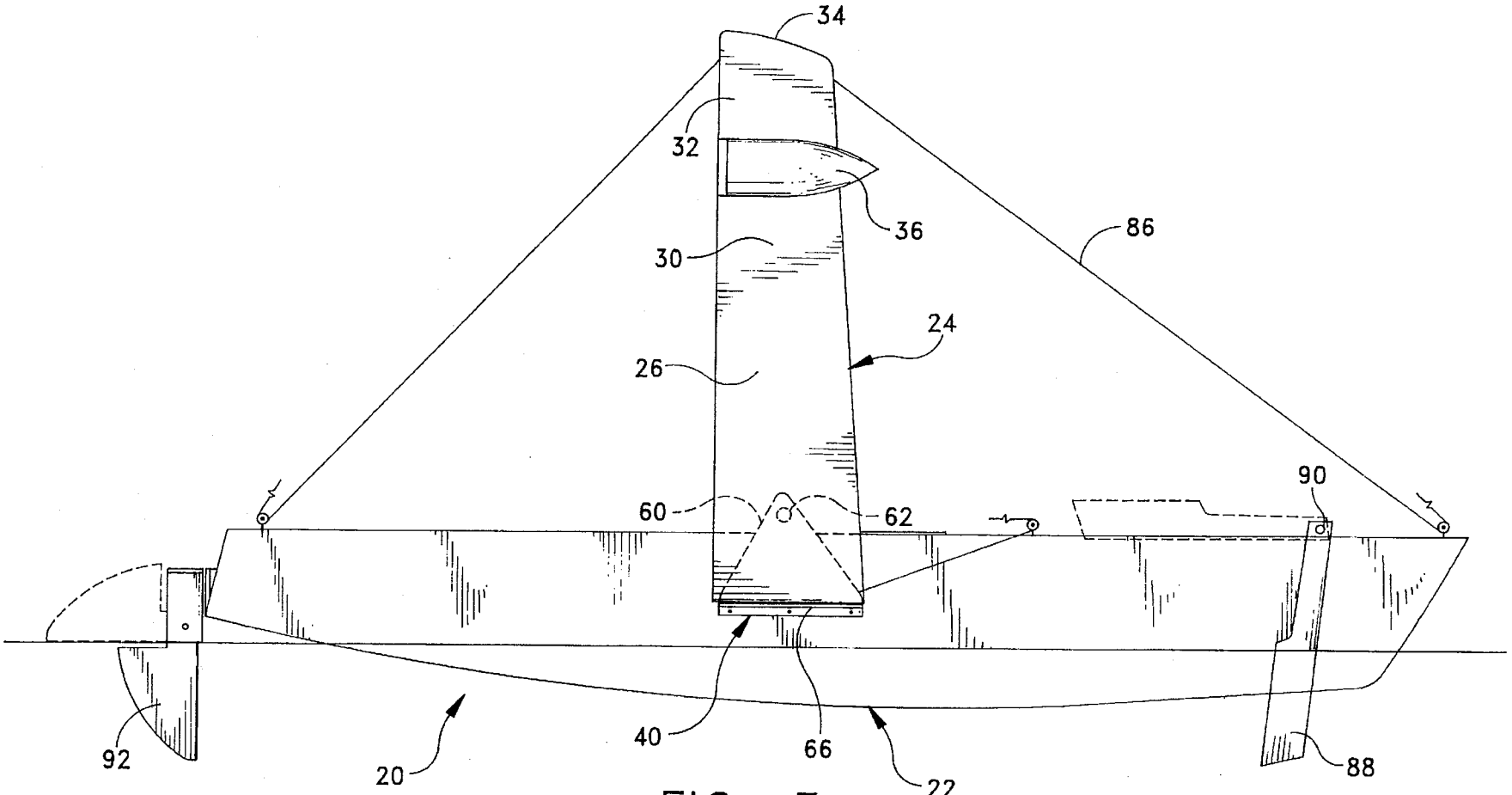
FIG. 3 is a side elevational view similar to FIG. 2 with the hydrofoil member being illustrated in an upwardly pivoted position.

The sailboat 20 further includes a pair of forwardly disposed rudders, each indicated at 88, which are pivotally mounted on the hull 22 of the sailboat 20 adjacent its bow. As illustrated in FIGS. 2–5, the rudders 88 are pivotally connected to one another by a bar 90 which is rotatably mounted at its center to a suitable mechanism (not designated) for steering the sailboat 20. The rudders 88 are each toed in approximately two degrees and are mounted on the bar 90 in the well-known manner. It has been found that by placing the rudders 88 near the bow of the sailboat 20, maneuverability and ease of steering of the sailboat is enhanced. A rigid stern lateral plane member 92 is further provided so as to provide lateral stability to the sailboat 20. As shown in FIG. 2, the member 92 has a pivotable mechanism which can be "kicked-up" upon engaging the ocean floor, for example.

The deployment of the hydrofoil members 24 from their stowed position to their use position is as follows. As illustrated in FIG. 2, the hydrofoil members 24, in their stowed position, extend along the side of the hull 22 of the sailboat 20 so that it may be docked or transported on a trailer along the roadway. To deploy the hydrofoil members 24, the rigging 86 enables the operator to move each member 24 to its vertical position illustrated in FIG. 3. More specifically, the rigging 86 includes a line that runs down from the mast of the boat to the outboard end of the hydrofoil member 24 for pulling the member up and for lowering it. The rigging 86 further enables the operator to lower the hydrofoil member 24 to a generally horizontal position which is illustrated in FIGS. 4–6. In order to secure each member 24 at a desired horizontal elevation and angle, the thrust arms 72 are rotated and pinned to the support bracket by pin 82. The elastomeric stop 64 protects the sailboat's hull 22 from rubbing against the plate 60. The pump hose 50 is connected at 70 so that water can be delivered to the ballast tanks 42 of the pontoon elements 36 for stabilizing the sailboat 20.

The hydrofoil members 24 are returned to their stowed position in the opposite manner described above. Moreover, they may be selectively mounted along the length of the track 69 so as to decrease the overall width of the sailboat 20 while docking or transporting the sailboat over the road. When anchored or moored, on hydrofoil member 24 can be used to prevent rolling action and movement. The other member 24 is retracted to reduce the overall width in crowded harbors. This is a significant advantage over multi-hulls which have difficulties maneuvering and docking in tight harbors.

Figure 9:
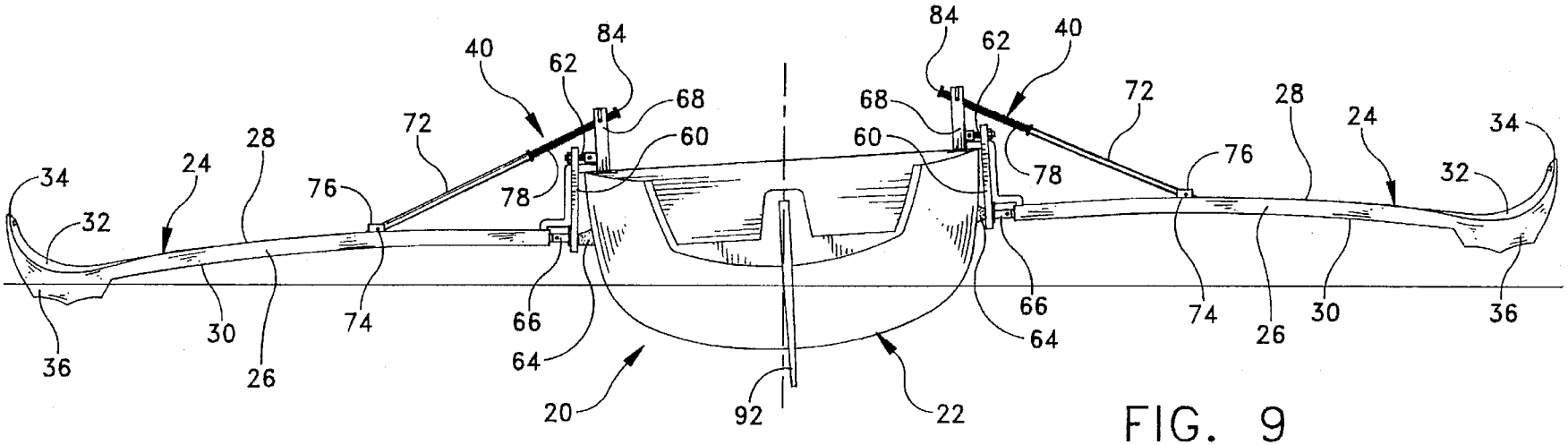
FIG. 9 is a rear elevational view similar to FIG. 6 illustrating the sailboat at five degrees heel, and the left-hand hydrofoil member at two degrees dihedral and the right-hand hydrofoil member at zero degree dihedral.
Figure 10:
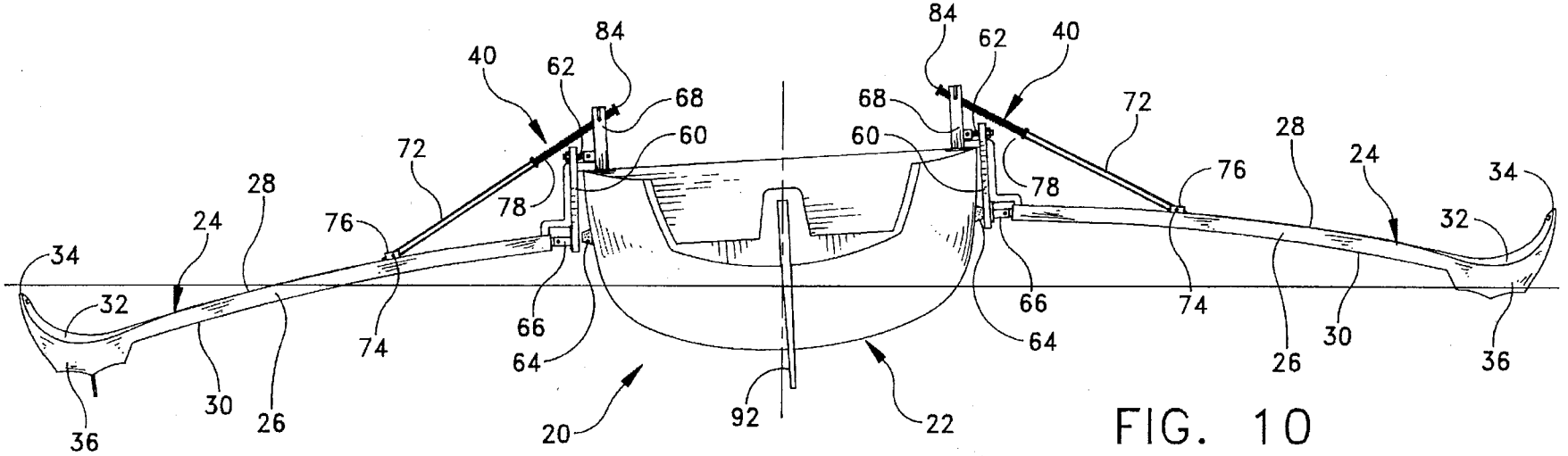
FIG. 10 is rear elevational view similar to FIGS. 6 and 9 illustrating the sailboat at five degrees heel, and the left-hand hydrofoil member at zero degree dihedral and the right-hand hydrofoil member at minus five degrees dihedral.

It should be observed that during use of the hydrofoil members 24, they provide lateral and vertical stability to the sailboat 20 without having to resort to a multi-hull design or to using lead or water weight within the hull 22 of the sailboat 20. Furthermore, the hydrofoil members 24 are easily adjustable to any elevation as witnessed in FIGS. 9 and 10. FIG. 9 illustrates the sailboat 20 at five degrees heel, and the left-hand hydrofoil member 24 at two degrees dihedral and the right-hand hydrofoil member 24 at zero degree dihedral. FIG. 10 illustrates the sailboat 20 at five degrees heel, and the left-hand hydrofoil member 24 at zero degree dihedral and the right-hand hydrofoil member 24 at minus five degrees dihedral. It should be noted that the members 24 can be adjusted until they contact the surface of the water as illustrated in FIG. 6. The change of angle of the hydrofoil members 24 can be achieved by rotating the thrust arms 72 in the manner described above. The plate 60 also adjust the angle of attack (horizontal of the hydrofoil member 24.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A hydrofoil member for a sailboat having a single hull extendable along a longitudinal axis, said hydrofoil member comprising:

an elongate arm portion adapted to extend laterally outwardly away from the single hulled sailboat along a generally horizontal plane when in use, said arm portion having an upwardly-facing surface and a downwardly-facing surface;

a pontoon element mounted on the downwardly facing surface of said arm portion, said pontoon element being adapted to engage and displace water when in use for stabilizing the sailboat; and means for hingedly and pivotally mounting said arm portion on the hull of said sailboat, said mounting means enabling the hinged movement of the arm portion about a plane generally perpendicular to the longitudinal axis of the sailboat so as to raise the arm portion from its aforementioned horizontal plane to a generally vertical plane, and the pivotal movement of the arm portion about a plane generally parallel to the longitudinal axis of the sailboat.

2. The hydrofoil member as set forth in claim 1, said pontoon element being integrally formed with said arm portion.

3. The hydrofoil member as set forth in claim 2, said pontoon element being of hollow construction for selectively storing fluid therein, said pontoon element, when filled with fluid, providing a ballast force against the sailboat for stabilizing the same.

4. The hydrofoil member as set forth in claim 3 further comprising means for supplying fluid to the pontoon element from the hull of the sailboat.

5. The hydrofoil member as set forth in claim 4, said fluid supplying means comprising a pump housed within the hull of the sailboat and a hose extending between the pump and the hollow pontoon element, said pump being in fluid communication with a reservoir of fluid for pumping fluid into and out of the hollow pontoon element.

6. The hydrofoil member as set forth in claim 1, said mounting means comprising a plate pivotally mounted by a pin to the hull of the sailboat, said arm portion being hingedly attached to the plate, the arrangement being such that the pontoon element is movable between a stowed position in which it extends along a side of the sailboat and a use position in which the pontoon element is pivoted to extend vertically and then hingedly lowered so as to achieve its generally horizontal position.

7. The hydrofoil member as set forth in claim 6, said mounting means further comprising a support bracket mounted on the hull of said sailboat, said plate being pivotally mounted by said pin to the support bracket.

8. A hydrofoil member for a sailboat having a single hull extendable along a longitudinal axis, said hydrofoil member comprising:

an elongate arm portion adapted to extend laterally outwardly away from the single hulled sailboat along a generally horizontal plane when in use, said arm portion having an upwardly-facing surface and a downwardly-facing surface, and an outer end portion which flares upwardly relative to said horizontal plane;

a pontoon element mounted on the downwardly facing surface of said arm portion at said outer end portion, said pontoon element being adapted to engage and displace water when in use for stabilizing the sailboat; and means for pivotally and hingedly mounting said arm portion of the hydrofoil member on the hull of said sailboat, said mounting means comprising a plate pivotally mounted by a pin to the hull of the sailboat, said arm portion being hingedly attached to the plate, the arrangement being such that the pontoon element is movable between a stowed position in which it extends along a side of the sailboat and a use position in which the pontoon element is pivoted to extend vertically and then hingedly lowered so as to achieve its generally horizontal position, and a support bracket mounted on the hull of said sailboat, said plate being pivotally mounted by said pin to the support bracket, and a thrust arm which is pivotally attached at an outer end thereof to the arm portion of the hydrofoil member and threadably attached at its other opposite end to the support bracket, said thrust arm controlling the elevation and angel of the hydrofoil member with respect to the horizontal plane.

9. A hydrofoil member for a sailboat having a single hull extendable along a longitudinal axis, said hydrofoil member comprising:

an elongate arm portion adapted to extend laterally outwardly away from the single hulled sailboat along a generally horizontal plane when in use, said arm portion having an upwardly-facing surface and a downwardly-facing surface, and an outer end portion which flares upwardly relative to said horizontal plane;

a pontoon element mounted on the downwardly facing surface of said arm portion at said outer end portion, said pontoon element being adapted to engage and displace water when in use for stabilizing the sailboat; and means for pivotally and hingedly mounting said arm portion of the hydrofoil member on the hull of said sailboat, said mounting means comprising a plate pivotally mounted by a pin to the hull of the sailboat, said arm portion being hingedly attached to the plate, the arrangement being such that the pontoon element is movable between a stowed position in which it extends along a side of the sailboat and a use position in which the pontoon element is pivoted to extend vertically and then hingedly lowered so as to achieve its generally horizontal position, and a support bracket mounted on the hull of said sailboat, said plate being pivotally mounted by said pin to the support bracket, said support bracket being slidably mounted on a track fixedly attached to the sailboat, said track having a plurality of stops for locating the support bracket along the track so that the hydrofoil member, plate and thrust arm can be moved along the length of the track.

* * * * *